US006817598B2

(12) United States Patent
Parrott et al.

(10) Patent No.: US 6,817,598 B2
(45) Date of Patent: Nov. 16, 2004

(54) GUN BRAKE DEVICE

(75) Inventors: Robert A. Parrott, Houston, TX (US); Stephen F. Lloyd, Sugar Land, TX (US); Gerhard Schoonderbeek, Stavanger (NO); Atilla Kaplan, Paris (FR); Henrik Praesius, Macae (BR); Kuo-Chiang Chen, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/280,744

(22) Filed: Oct. 25, 2002

(65) Prior Publication Data

US 2003/0089504 A1 May 15, 2003

Related U.S. Application Data

(60) Provisional application No. 60/349,159, filed on Oct. 26, 2001.

(51) Int. Cl.[7] ..... F16F 9/18

(52) U.S. Cl. ..... 267/125; 267/137; 188/119; 188/129; 188/139; 166/382; 166/55.1; 166/5.3

(58) Field of Search ..... 188/65.1, 65.4, 188/82.8, 119, 129, 136, 139, 346, 151 A, 188; 267/205, 217, 64.11, 64.13, 124, 125, 137; 166/382, 55, 55.1, 66.7, 298, 297, 55.3

(56) References Cited

U.S. PATENT DOCUMENTS 1,553,195 A 9/1925 Smith
3,947,008 A * 3/1976 Mullins ..... 267/137
3,963,228 A * 6/1976 Karle ..... 267/166
3,998,443 A * 12/1976 Webb ..... 267/125
4,133,516 A * 1/1979 Jurgens ..... 267/125
4,171,025 A * 10/1979 Bassinger ..... 175/65
4,210,316 A * 7/1980 Hall ..... 267/125
4,223,746 A * 9/1980 Tanguy et al. ..... 175/40
4,331,006 A * 5/1982 Bishop ..... 464/18
4,387,885 A * 6/1983 Bishop et al. ..... 267/125
4,439,167 A * 3/1984 Bishop et al. ..... 464/20
4,552,230 A * 11/1985 Anderson et al. ..... 175/321
4,901,806 A * 2/1990 Forrest ..... 175/321
5,183,113 A * 2/1993 Leaney et al. ..... 166/316
5,343,963 A * 9/1994 Bouldin et al. ..... 175/27
6,003,599 A * 12/1999 Huber et al. ..... 166/255.2
6,223,818 B1 5/2001 Hrupp
6,308,940 B1 * 10/2001 Anderson ..... 267/125
6,315,043 B1 * 11/2001 Farrant et al. ..... 166/297
6,631,769 B2 * 10/2003 Cook et al. ..... 166/380

FOREIGN PATENT DOCUMENTS

EP 418056 * 3/1991

* cited by examiner

*Primary Examiner*—Robert A. Siconolfi
*Assistant Examiner*—Devon Kramer
(74) *Attorney, Agent, or Firm*—Robert A. Van Someren; Jeffrey Griffin; Brigitte Echols

(57) ABSTRACT

The present invention provides a gun brake system adapted to slow the descent of a tool string in a well. In one embodiment, the brake system comprises a brake installed within the well and having a snug fitting restriction and one or more fluid channels extending along a portion thereof. The brake system further provides means for maintaining the fluid volume substantially constant within the production tubing to which the gun brake is installed.

13 Claims, 4 Drawing Sheets

GUN BRAKE DEVICE

This application claims the benefit of U.S. Provisional Application No. 60/349,159, filed Oct. 26, 2001.

FIELD OF THE INVENTION

The subject matter of the present invention relates to a gun brake system. More specifically, the subject matter of the present invention relates to a gun brake system adapted to protect a subsea safety valve from a dropped gun string.

BACKGROUND OF THE INVENTION

A subsea safety valve is typically positioned in the production tubing several hundred meters below the surface. On many existing completions, during a perforating workover operation, the subsea safety valve is the only pressure control device that is available when a perforating gun string is being introduced or removed from the wellbore while the gun string is above the subsea safety valve.

If the well starts "blowing out" during deployment of the perforating gun string, the guns are dropped into the well, and the blind/shear rams are closed. The dropped gun string can impact and potentially damage the subsea safety valve, causing the completion to have to be pulled at great expense and productivity damage to the producing formation.

There exists, therefore, a need for a system that protects the subsea safety valve from a dropped gun string.

DETAILED DESCRIPTION OF PREFERRED EMBODIMENTS

Figure 1:
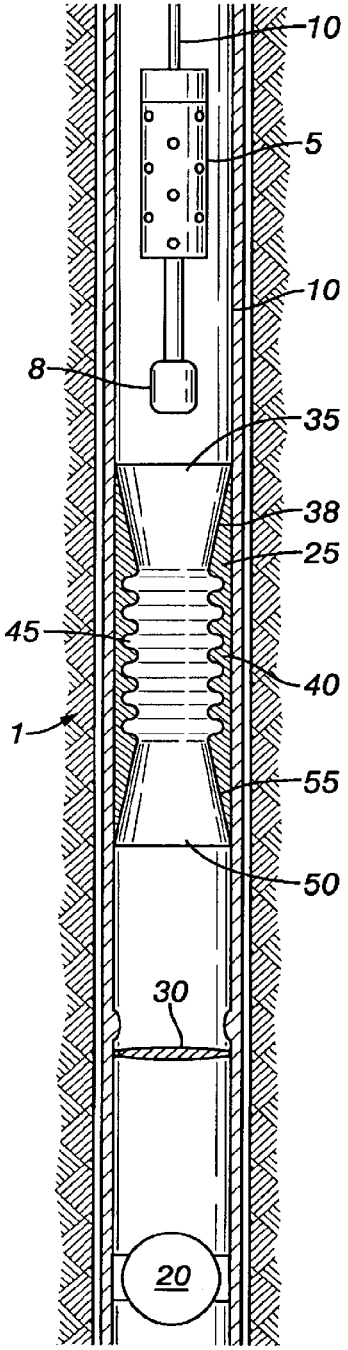
FIG. 1 is sketch of an embodiment of the gun brake system of the present invention.

FIG. 1 provides a schematic illustration of one embodiment of the gun brake system, indicated generally as 1. As illustrated, a perforating gun string 5 is being lowered on wireline 10 into production tubing 15. A subsurface safety valve 20 is positioned within the production tubing 15. Typically, the subsurface safety valve 20 is installed several hundred meters below the surface.

In this embodiment, the gun brake system 1 is principally comprised of a gun brake 25 and a flapper valve 30. The gun brake 25 is installed above the safety valve 20 at a distance that will enable the brake 25 to safely slow the descent of a dropped gun string 5 to protect the safety valve 20. Absent the gun brake 25, a dropped gun string 5 will free fall until striking the safety valve 20 with substantial velocity and force. Such falls can result in severe and costly damage to the safety valve 20.

At its upper end 35, the gun brake 25 has an upper sloped surface 38 that acts to guide the gun string 5 into the gun brake 25 and ensures that the gun string 5 will remain substantially centered as it descends therethrough. Similarly, at its lower end 50, the gun brake 25 has a lower sloped surface 55 that acts to guide the gun string 5 back into the gun brake 25 after the guns have been fired. The lower sloped surfaces 55 facilitate retrieval of the gun string 5.

The sloped surfaces 38, 55 terminate at the brake body 40. The brake body 40 is a long and relatively snug fitting restriction. The length and inner diameter of the brake body 40 is dependent upon the length and outer diameter of the gun string 5 being lowered therethrough. The length of the brake body 40 is also dependent upon the relative location of the safety valve 20. Along a portion of the brake body 40 are fluid channels 45. The number and depth of the channels is dependent upon the weight of the gun string 5 and the relative location of the safety valve 20.

The flapper valve 30 is installed below the gun brake 25 and above the safety valve 20. In its closed state, the flapper valve 30 maintains a limited wellbore fluid volume. The flapper valve 30 impedes the free flow of wellbore fluid while the safety valve 20 is open, thus maintaining a limited wellbore fluid volume in the production tubing 15 above the flapper valve 30. In other words, the wellbore fluid volume in the portion of the production tubing where the gun brake 25 is installed, remains substantially constant.

It should be noted that although the described embodiment of the gun brake system 1 uses a flapper valve 30 to maintain the wellbore fluid volume, any number of valves, including additional safety valves can be utilized to achieve the intended result.

In normal operation, the perforating gun string 5 is run downhole on the wireline 10. The gun string 5 passes through the gun brake 25 and then must open the flapper valve 30. In the embodiment shown, affixed to the bottom of the gun string 5 is a shifting tool 8 adapted to open the flapper valve 30. After the firing of the guns, the gun string 5 is retrieved back through the gun brake 25.

If the well starts "blowing out" during deployment of the perforating gun string 5, the safety valve 20 must be closed and the gun string 5 must be dropped. With the gun brake 25 installed, the descent of the gun string 5 is slowed such that the gun string 5 does not strike the safety valve 20 with a velocity and force that can damage the safety valve 20. The descent of the gun string 5 is slowed by the interaction of the gun string 5, the gun brake 25 and the wellbore fluid.

After being dropped, the perforating gun string 5 descends through the gun brake 25 and travels therethrough the brake body 40 characterized as a snug fitting restriction. With a limited wellbore fluid volume maintained by the flapper 30, the descent of the gun string 5 forces the wellbore fluid to be quickly channeled between the fluid channels 45 of the gun brake 25 and the gun string 5. The resistance to the fluid flow acts to slow the velocity of the dropped gun string 5. It should be noted that although the embodiment described uses wellbore fluid to slow the gun string 5, any number of other fluids could be maintained in the production tubing 15 above the flapper valve 30 to achieve the same result.

Figure 2A:
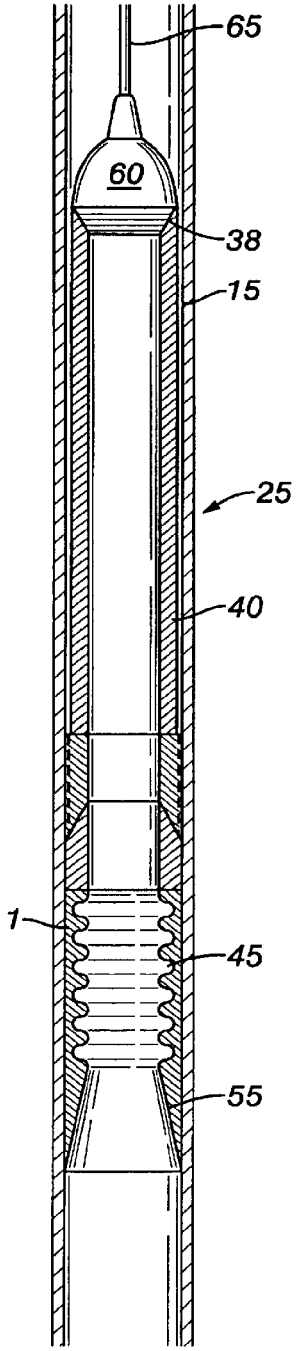
FIGS. 2A–E illustrates of an embodiment of the deployment and removal of an embodiment of the gun brake system from a well.

FIGS. 2A–2E illustrate the deployment and removal of an embodiment of the gun brake 25 into and out of a well. As shown in FIG. 2A, the gun brake 25 comprises an upper sloped surface 38, a brake body 40 acting as a snug fitting restriction, a series of channels 45 running along a portion of the brake body 40, and a lower sloped surface 55. The gun brake 25 is lowered into the production tubing 15 with a running tool 60 conveyed by means such as wireline, tubing, or slickline 65. The gun brake 25 is lowered to a depth above the safety valve (not shown) that will enable the descent of a dropped gun string 5 to be slowed to prevent striking the safety valve 20 with potential damaging velocity and force.

Figure 2B:
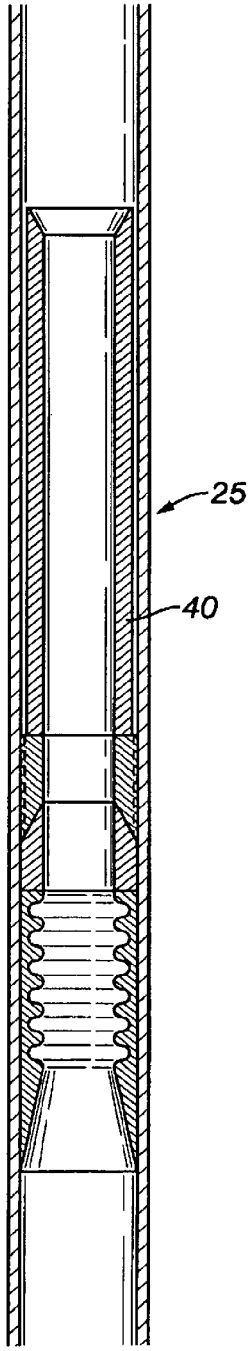

While at the appropriate depth, the gun brake 1 is installed, or set, using standard setting equipment such as that used for packers or bridge plugs. FIG. 2B illustrates the set gun brake 25 after having been released by the running tool 60.

Figure 2C:
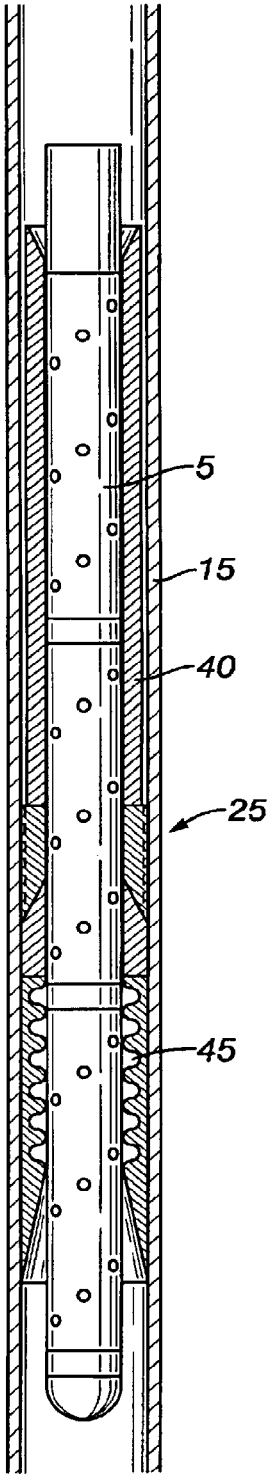

FIG. 2C illustrates the gun string 5 being lowered through the production tubing 15 and into the gun brake 25. The gun string S is guided into the gun brake 25 by the upper sloped surface 38 of the gun brake 25. As illustrated, the brake body 40 is a snug fitting restriction having an inner diameter just larger than that of the gun string 5. As such, dropping of the gun string 5 through the brake body 40 forces existing wellbore fluid into the channels 45. The resistance to such fluid flow acts to slow the descent of the gun string 5.

Figure 2D:
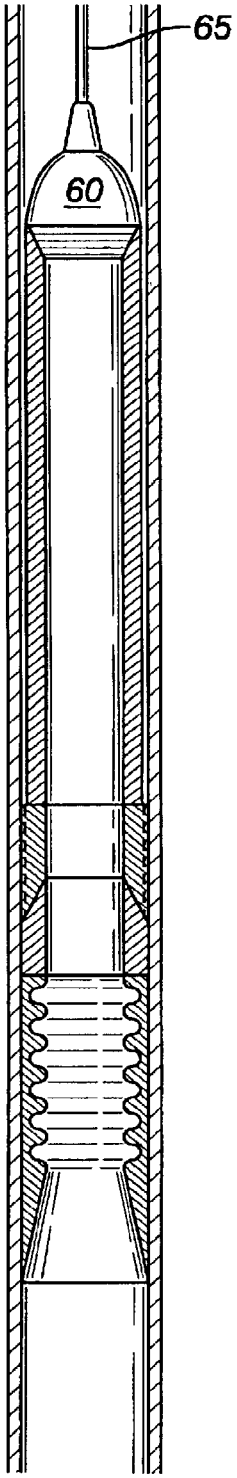
Figure 2E:
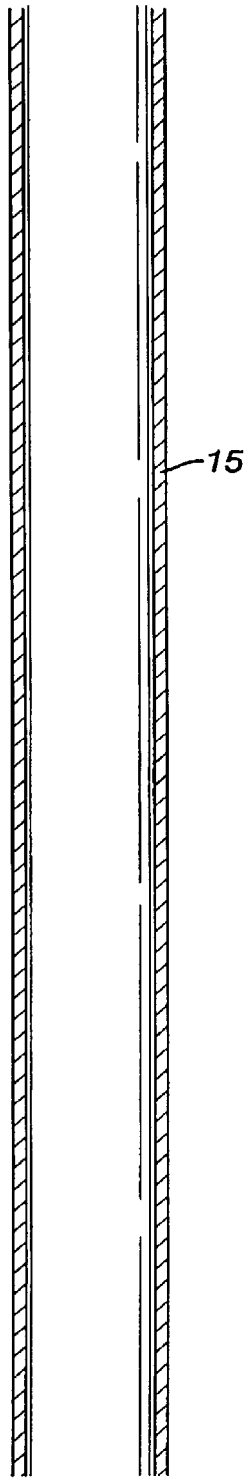

After the guns of the gun string 5 have been fired, the running tool 60 is lowered by means such as wireline, tubing or slickline 65 back into engagement with the gun brake 25 as shown in FIG. 2D. The setting means is released and the gun brake 1 is removed from the production tubing 15 as shown in FIG. 2E.

Figure 3:
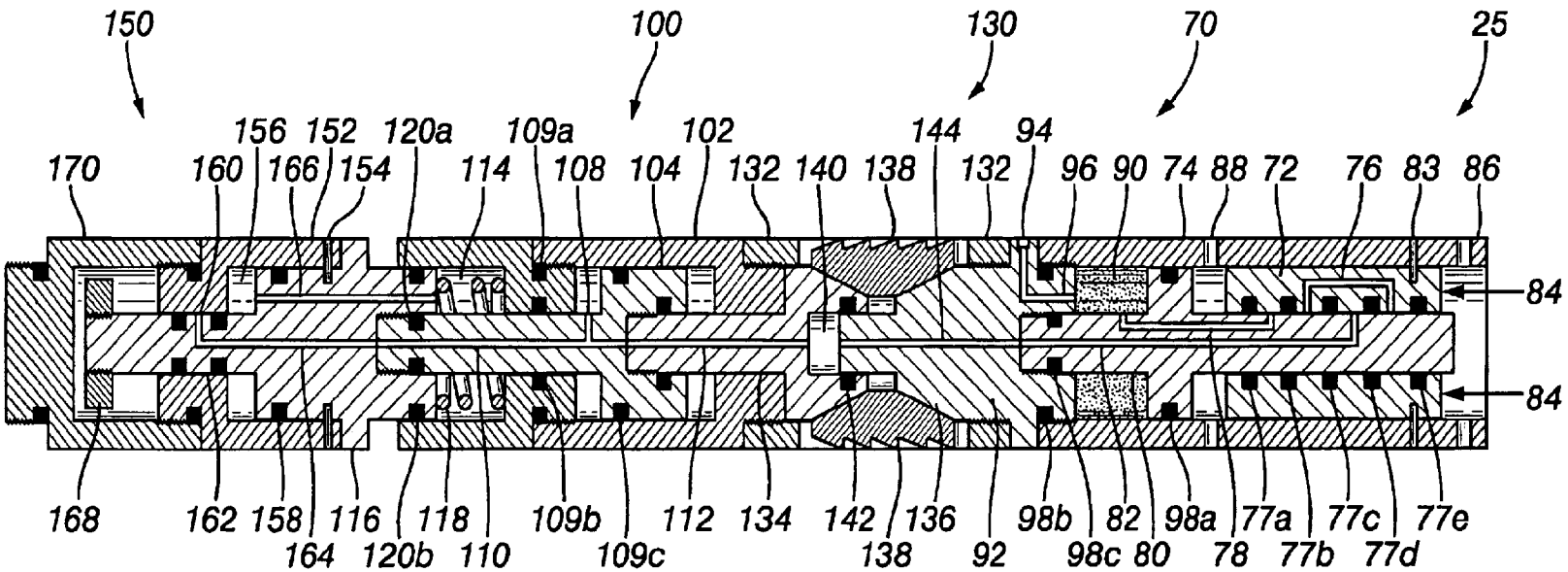
FIG. 3 is a cross-sectional view of an embodiment of the gun brake system shown prior to activation.
Figure 4:
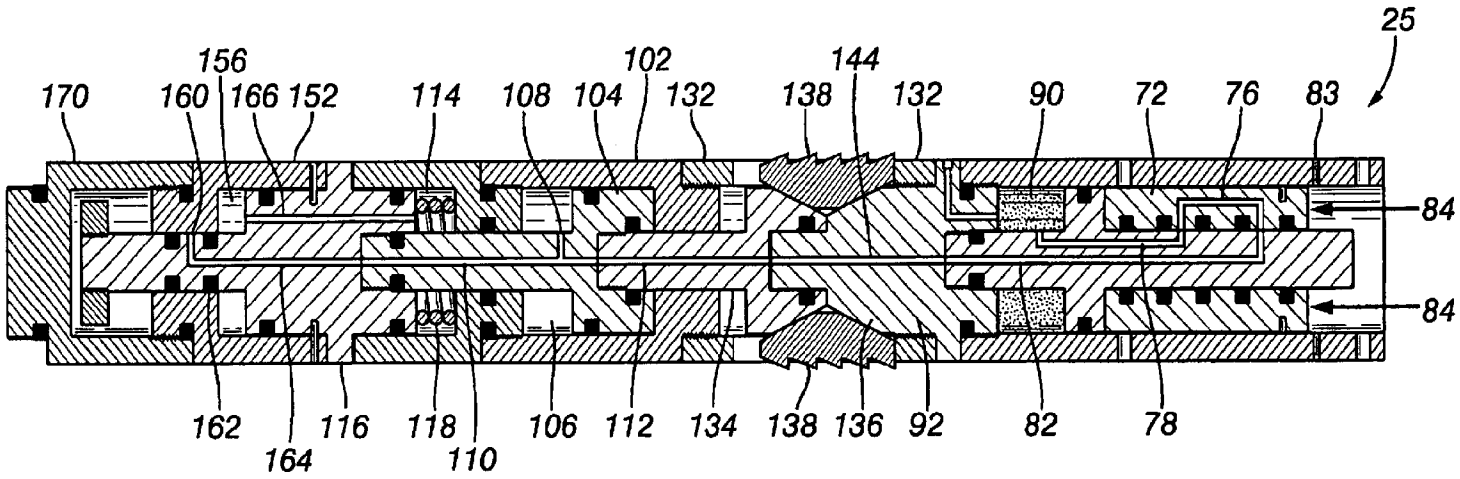
FIG. 4 is a cross-sectional view of an embodiment of the gun brake system shown in its actuated state.
Figure 5:
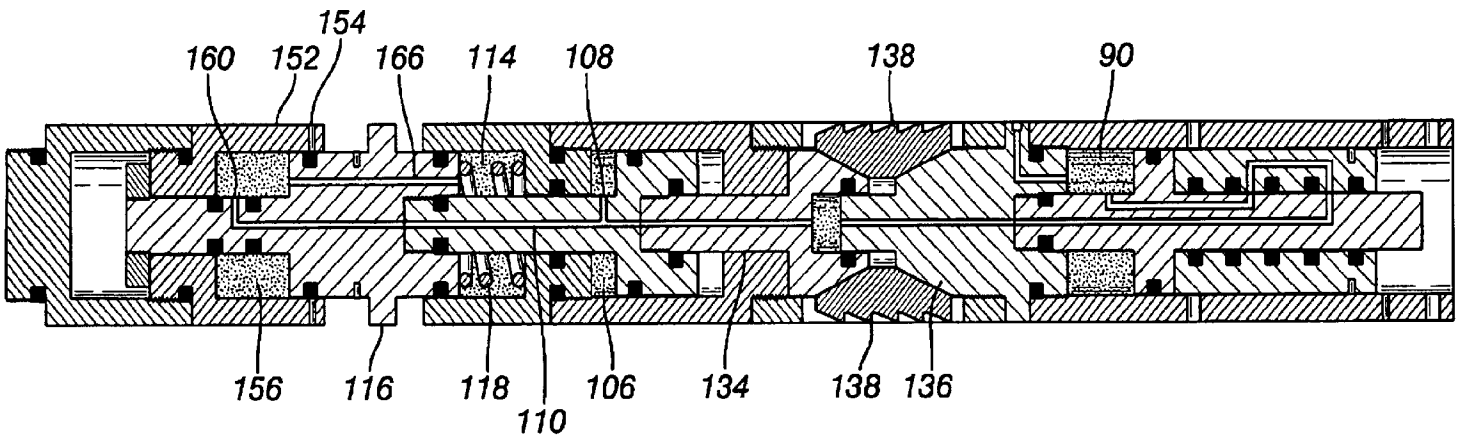
FIG. 5 is a cross-sectional view of an embodiment of the gun brake system shown after the brake has been released from its actuated state.

Another embodiment of the gun brake system 1 is shown in FIGS. 3–5. The illustrations of FIGS. 3–5 are cross-sectional views wherein the left-hand side of the drawings represents the topside of the tool. FIG. 3 illustrates this embodiment of the gun brake 25 shown prior to its activation. FIG. 4 illustrates this embodiment of the gun brake 25 shown in its actuated state. FIG. 5 illustrates this embodiment of the gun brake 25 shown after the brake has been released from its actuated state. Although not shown, it is understood that the gun brake 25 is attached to the lower end of a tool string carrying one or more perforating guns, for example.

In this embodiment, the gun brake 25 is generally comprised of a switch 70, an actuation mechanism 100, a braking mechanism 130, and a release mechanism 150. The switch 70 senses any undesirable downward motion, or threshold velocity, of the tool string to which it is attached and activates. Upon activation, energy is supplied to the actuation mechanism 100 that in turn energizes the braking mechanism 130. The braking mechanism 130 engages the inner diameter of the completion (tubing or casing) to slow and eventually stop the tool string. As stated above, such braking acts to prevent the tool string from damaging devices below such as safety valves. When the tool string is ready to be retrieved, the release mechanism 150 is activated to release the brake 25 and free the string.

Referring to FIG. 3, the switch 70 has a switch piston 72 within a switch housing 74. The switch piston 72 has a switch conduit 76 contained therein. Several switch seals 77*a*–77*e* isolate the inlet and outlet of the switch conduit 76.

The role of the switch seals 77*a*–77*e* is as follows. Switch seal 77*b* isolates the switch conduit 76 from the energy conduit 78 housed within the activation shaft 80. Switch seals 77*c* and 77*d* isolate the switch conduit 76 from the switch supply line 82 that is also housed within the activation shaft 80. Switch seal 77*e* isolates the switch conduit 76 from the downhole environment. Likewise, switch seal 77*a* isolates the energy conduit 78 from the downhole environment.

Prior to activation of the switch 70, the switch piston 72 is held in position by activation pins 83. The overall strength of the activation pins 83 is greater than the force 84 acting on the switch piston 72 as the gun brake 25 travels at normal speed (i.e., lowering the tool string in a controlled fashion), but is lower than the force 84 acting on the switch piston 72 when the gun brake 25 is traveling at an undesirable speed (e.g., uncontrolled free fall). The undesirable speed is considered the threshold velocity of the gun brake 25.

The force 84 acting on the switch piston 72 is generated by the so-called "piston-effect." The piston-effect force on a flat surface increases when the speed of fluid hitting the flat surface increases. Thus, if the tool string is dropped and is free falling through the production tubing, the switch piston 72 will be subjected to substantially increased piston-effect forces generated by the increased velocity of the gun brake 25 travel through the wellbore fluids.

The switch piston 72 is not moved by the differential pressure across the gun brake 25 because of pressure balance openings 86 and 88 that act to balance out the pressure on both sides of the switch piston 72. Thus, the only means to activate the switch piston 72 is going to be with the piston-effect force 84.

Within the switch housing 74 is an energy chamber 90 defined by the housing 74, the activation shaft 80, and the lower adapter 92. In one embodiment, the energy source contained within the energy chamber 90 is nitrogen gas. However, it should be noted that other gases and liquids can be used to advantage as the energy source. The nitrogen gas is pumped into the energy chamber 90 through the filling port 94 and the filling conduit 96. The energy chamber 90 is pressure-sealed by energy seals 98*a*, 98*b*, and 98*c*.

The energy chamber 90 is connected to the inside diameter of the switch piston 72 by the energy conduit 78. Prior to activation of the switch 70, the energy conduit 78 is unable to communicate with the switch conduit 76 thereby leaving the pressurized nitrogen trapped inside the energy chamber 90.

The actuation mechanism 100 is primarily comprised of the actuation housing 102 and the actuation piston 104. An actuation chamber 106 is defined by the actuation housing 102 and the actuation piston 104. The actuation chamber 106 is isolated from the outside environment by actuation seals 109*a*, 109*b*, and 109*c*. Prior to activation, the pressure inside the actuation chamber 106 is atmospheric.

An actuation conduit 108 connects the actuation chamber 106 with the actuation supply line 110 that in turn connects to the upper brake supply line 112.

A spring chamber 114 is defined by the actuation housing 102, the actuation piston 104, and the upper adapter 116. The spring chamber 114 houses a retraction spring 118 and is isolated from the environment by actuation seal 109*b* and spring seals 120*a* and 120*b*. Prior to activation of the gun brake 25, the pressure inside the spring chamber 114 remains atmospheric.

The actuation mechanism 100 is "pressure-balanced" from outside pressure as long as the cross-sectional area of the actuation chamber 106 is the same as the cross-sectional area of the spring chamber 114. Thus, the force generated by the actuation mechanism 100 is not affected by the downhole pressure.

In the embodiment shown, the braking mechanism 130 utilizes the slip/wedge design. As such, the braking mechanism 130 is comprised of a brake housing 132, an upper wedge 134, a lower wedge 136, and slips 138.

The slips 138 ride on the top of the tapered surfaces of the upper wedge 134, and the lower wedge 136. In some embodiments, the slips 138 additionally comprise dovetails for engagement with each other. When the lower wedge 136 moves toward the upper wedge 134, the slips 138 are forced outward. Conversely, when the lower wedge 136 moves away from the upper wedge 134, the dovetails drag the slips 138 inward.

The braking mechanism 130 further comprises a brake chamber 140 defined by the upper wedge 134 and the lower wedge 136. The brake chamber 140 is isolated from the outside environment by the brake seal 142. The brake chamber 140 is connected to the actuation chamber 106 via the actuation conduit 108 and the actuation supply line 110. Additionally, the brake chamber 140 is connected to the switch supply line 82 via the lower adapter supply line 144.

The release mechanism 150 primarily comprises the upper adapter 116 and the release housing 152. The upper adapter 116 and the release housing 152 are connected by the release pins 154. The total strength of the release pins 154 is greater than the weight of the gun brake 25 and can sustain normal shocks during transportation downhole. The strength of the release pins 154 is, however, less than a pre-set value of a pulling force.

A release chamber 156 is defined by the upper adapter 116 and the release housing 152. The release chamber 156 is isolated from the outside environment by the first release seal 158. Prior to release of the tool, the release chamber 156 is isolated from the release conduit 160 by the second release seal 162. The release conduit 160 is connected to the upper adapter supply line 164. The release chamber 156 is always connected to the spring chamber 114 via the spring conduit 166.

A release nut 168 is threaded to the upper adapter 116. The release nut 168 prevents the complete separation of the upper adapter 116 from the release housing 152 after the release pins 154 have been sheared. Once the release pins 154 have been sheared, this design can also be used as a jar to provide a second means to retrieve the gun brake 25 in the event the brake (or slips) become jammed.

Activation of this embodiment of the gun brake 25 is best described with reference to FIGS. 3 and 4. FIG. 3 illustrates the gun brake 25 prior to activation while FIG. 4 illustrates the gun brake 25 in its activated state.

Once the piston-effect force 84 acting on the switch piston 72 becomes larger than the total shear strength of the activation pins 83, the activation pins 83 will shear and the switch piston 72 will move upward. As discussed above, the piston-effect force 84 will increase beyond the total shear strength of the activation pins 83 when the gun string 25 is traveling above the threshold velocity. Such velocity may be reached upon release of the tool string during a "blow-out" situation, for example.

With the switch piston 72 in its uppermost position, the switch conduit 76 becomes aligned with the energy conduit 78 and the switch supply line 82. Consequently, the pressurized nitrogen gas flows from the energy chamber 90 through the energy conduit 78, through the switch conduit 76, through the switch supply line 82, through the lower adapter supply line 144, through the upper brake supply line 112, through the actuation supply line 110, through the actuation conduit 108, and into the actuation chamber 106.

At this point, the nitrogen pressure is isolated from the release chamber 156 by operation of the second release seal 162. Thus, the pressure inside spring chamber 114, which is connected to the release chamber 156 by the spring conduit 166, remains atmospheric. The net force F acting on the actuation housing 102 is, $$F=P_1A_1-P_2A_2-F_s \qquad \text{Equation (1)}$$

Where $P_1$ is the gas pressure inside the actuation chamber 106, $P_2$ is the atmospheric pressure inside the spring chamber 114, $A_1$ is the cross-sectional area of the actuation chamber 106, $A_2$ is the cross-sectional area of the spring chamber 114, and $F_s$ is the spring force of the retraction spring 118.

The atmospheric pressure $P_2$ is relatively small compared to $P_1$. Therefore, the contribution of $P_2$ can be ignored from Equation 1. Additionally, as discussed above, the cross-sectional areas $A_1$ and $A_2$ are equivalent. Thus, Equation 1 can be simplified as follows, $$F=P_1A_1-F_s \qquad \text{Equation (2)}$$

Because the net force F is greater than zero, the actuation housing 102 will move upward and compress the retraction spring 118. As the actuation housing 102 moves upwards, it drags the brake housing 132, the lower adapter 92, and the lower wedge 136 upward.

While the lower wedge 136 moves upward, the upper wedge 134 remains relatively stationary. The upper wedge 134 is connected to the actuation piston 104 which is in turn connected to the upper adapter 116, the release housing 152, and the tool string adapter 170, which all remain stationary with the rest of the tool string above. Thus, the relative movement of the lower wedge 136 forces the slips 138 to move outward into engagement with the completion (tubing or casing). As the slips 138 move outward, the tool string is slowed and eventually stopped.

Release of this embodiment of the gun brake 25 is best described with reference to FIGS. 4 and 5. FIG. 4 illustrates the gun brake 25 in its activated state, while FIG. 5 illustrates the gun brake 25 in its released state.

In typical operations, when a tool string is ready to be removed from the completion of a well, a fishing tool is conveyed by means such as wireline, coiled tubing, or slickline. The fishing tool is lowered into the well until it engages the top of the tool string. Once engaged, the tool string can be pulled.

In the present invention, when the pulling force of the fishing tool (not shown) is greater than the total strength of the release pins 154, the release pins 154 are sheared and the release housing 152 is pulled away from the upper adapter 116 until the release housing 152 abuts the release nut 168.

In this position, the release chamber 156 is connected to the actuation chamber 106 by the release conduit 160, the upper adapter supply line 164, and the actuation supply line 110. Additionally, the spring chamber 114 is now connected all the way back to the energy chamber 90. Consequently, the spring chamber 114 is filled nitrogen gas with the same pressure as the rest of the circuit. At this point, the net force F acting on the actuation housing 102 is, $$F=P_1A_1-P_2A_2-F_s \qquad \text{Equation (3)}$$

Where $P_1$ is the gas pressure inside the actuation chamber 106, $P_2$ is the atmospheric pressure inside the spring chamber 114, $A_1$ is the cross-sectional area of the actuation chamber 106, $A_2$ is the cross-sectional area of the spring chamber 114, and $F_s$ is the spring force of the retraction spring 118.

The pressure $P_1$ is now equal to $P_2$. Thus, Equation 3 can be simplified as follows, $$F=-F_s \qquad \text{Equation (4)}$$

As such, the retraction spring 118 pushes the upper adapter 116, the actuation housing 102, the brake housing 132, the lower adapter 92, and the lower wedge 136 back to their initial positions. When this happens, the lower wedge 136 moves downward and away from the upper wedge 134 and the dovetails (not shown) on the slips 138 help the lower wedge 136 pull the slips 138 inward. As a result, the slips 138 disengage the completion and the tool string and the gun brake 25 are free to be removed from the well.

The invention being thus described, it will be obvious that the same may be varied in many ways. Such variations are not to be regarded as a departure from the spirit and scope of the invention and are intended to fall within the scope of the following non-limiting claims:

We claim:

1. A brake system adapted to slow the descent of a tool string in a well containing fluid, comprising:

a tool brake installed within the well and having a snug fitting restriction and one or more fluid channels extending along a portion of the length of the tool brake, and a mechanism for maintaining a volume of fluid in communication with the tool brake substantially constant.

2. The brake system of claim 1, wherein the tool string is a perforating gun string.

3. The brake system of claim 1, wherein the tool string is free-falling.

4. The brake system of claim 1, wherein the fluid is wellbore fluid.

5. The brake system of claim 1, wherein the mechanism for maintaining the fluid volume substantially constant is a flapper valve.

6. A brake system adapted to slow the descent of a tool string in a well containing fluid, comprising:

a tool brake installed within the well and having a snug fitting restriction and one or more fluid channels extending along a portion of the length of the tool brake, and a mechanism for maintaining a volume of fluid in communication with the tool brake substantially constant, wherein the tool brake further comprises sloped surfaces to facilitate the tool string entering the tool brake.

7. A method of slowing the descent of a tool string in a well containing fluid, comprising:

installing a tool brake having a snug fitting restriction and one or more fluid channels, and maintaining a volume of fluid in communication with the tool brake substantially constant.

8. The method of claim 7, wherein installing comprises installing the tool brake for a perforating gun string.

9. The method of claim 7, wherein installing comprises installing the tool brake to slow a free-falling tool string.

10. The method of claim 7, comprising forming the tool brake with sloped surfaces to facilitate the tool string entering the tool brake.

11. The method of claim 7, wherein maintaining comprises maintaining a volume of wellbore fluid in communication with the tool brake.

12. The method of claim 7, wherein maintaining comprises maintaining the fluid volume substantially constant with a flapper valve.

13. A method of slowing the descent of a released tool string, comprising:

installing a tool brake having a restricted inner diameter and one or more channels, maintaining a fluid volume within the tool brake, and using the resistance to fluid flow into the one or more channels to slow the released tool string.

* * * * *